US006890427B2

(12) United States Patent
Self et al.

(10) Patent No.: US 6,890,427 B2
(45) Date of Patent: May 10, 2005

(54) WASTE WATER OUTLET UNIT

(75) Inventors: James Edward Self, Isle of Man (GB); Graham Robin Lock, Isle of Man (GB)

(73) Assignee: DLP Limited, Isle of Man (GB)

( * ) Notice: Subject to any disclaimer, the term of this patent is extended or adjusted under 35 U.S.C. 154(b) by 122 days.

(21) Appl. No.: 10/370,690

(22) Filed: Feb. 24, 2003

(65) Prior Publication Data

US 2003/0159978 A1 Aug. 28, 2003

(30) Foreign Application Priority Data

Feb. 23, 2002 (GB) ..... 0204313

(51) Int. Cl.[7] ..... B01D 35/02

(52) U.S. Cl. ..... 210/163; 210/238; 210/416.1; 210/456; 210/463; 210/470; 4/288

(58) Field of Search ..... 210/153, 163, 210/164, 320, 456, 459, 460, 463, 238, 416.1, 348, 451, 470; 4/286–292; 285/42, 139.1, 139.2, 204; 277/642

(56) References Cited

U.S. PATENT DOCUMENTS 126,624 A * 5/1872 Coffee ..... 277/649
2,859,452 A * 11/1958 Seewack ..... 210/165
3,181,899 A * 5/1965 McKnight, Jr. ..... 285/139.2
6,418,569 B1 * 7/2002 Knight ..... 4/287

FOREIGN PATENT DOCUMENTS

| | | |
|---|---|---|
| DE | 93 01 155.5 | 3/1993 |
| DE | 197 41 827 A1 | 3/1999 |
| EP | 0 078 593 | 5/1983 |
| FR | 1 493 470 | 9/1967 |
| JP | A 11-36402 | 2/1999 |
| WO | 99/51824 | 10/1999 |

* cited by examiner

*Primary Examiner*—Matthew O. Savage
(74) *Attorney, Agent, or Firm*—Young & Thompson

(57) ABSTRACT

A waste water outlet unit, for a shower tray having a drain opening, comprises a base element which is locatable on the underside of the shower tray to cover the drain opening, and a clamp element which is locatable on the topside of the shower tray and which is engageable with the base element to clamp the base element to the underside of the shower tray. The clamp element has an aperture through which waste water from the shower tray can pass into the base element, and a filter element which is positionable over the aperture and which can be removed to enable access to the interior of the unit while maintaining the engagement between the base and clamp elements.

14 Claims, 2 Drawing Sheets

WASTE WATER OUTLET UNIT

FIELD OF THE INVENTION

This invention relates to a waste water outlet unit for a shower tray.

BACKGROUND OF THE INVENTION

A waste water outlet unit for a shower tray is known and generally comprises an apertured top grille part and a bottom part. The bottom part is clamped to the underside of the shower tray by the top grille part being positioned on the topside of the shower tray and then engaged with the bottom part. The waste water from the shower tray drains over and through the apertures of the top grille part into the bottom part. The bottom part has a waste water outlet which is connected to a drain pipe.

A problem with this type of unit becomes apparent when access to the interior of the bottom part is required, for example for cleaning or maintenance. Access can only be gained by removing the top grille part, and to do this the top grille part must first be released from the bottom part. However, once released, the bottom part becomes free to move relative to the shower tray. It can thus be difficult, if not impossible, to re-clamp the bottom part, especially after the shower tray has been installed.

The present invention seeks to overcome this problem.

SUMMARY OF THE INVENTION

According to the present invention, there is provided a waste water outlet unit for a shower tray having a drain opening, the unit comprising a base element which is locatable on the underside of the shower tray to cover the drain opening, and a clamp element which is locatable on the topside of the shower tray and which is engageable with the base element to clamp the base element to the underside of the shower tray, the clamp element having an aperture through which waste water from the shower tray can pass into the base element, a filter element which is positionable over the aperture and which can be removed to enable access to the interior of the unit while maintaining the engagement between the base and clamp elements and a removable cover which, when in place, prevents removal of the removable filter element and which, in use, restricts the flow rate of liquid into the base element.

DESCRIPTION OF THE PREFERRED EMBODIMENTS

Figure 1:
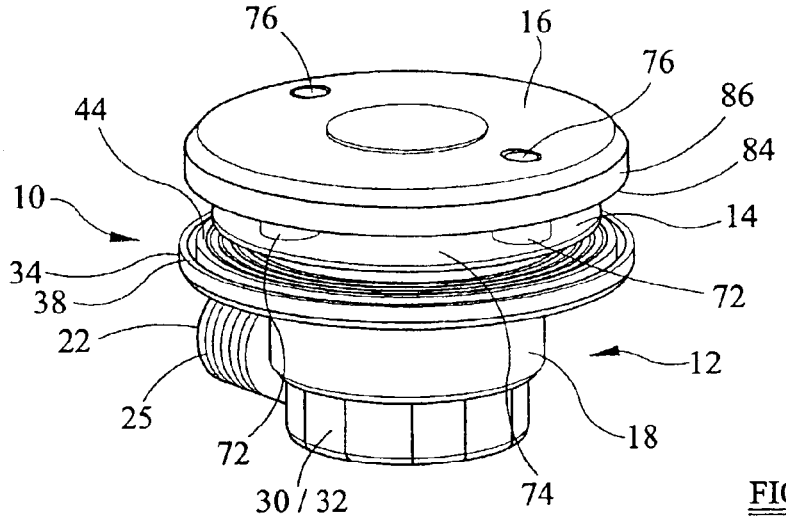
FIG. 1 is a perspective view of a first embodiment of a waste water outlet unit, in accordance with the present invention.
Figure 2:
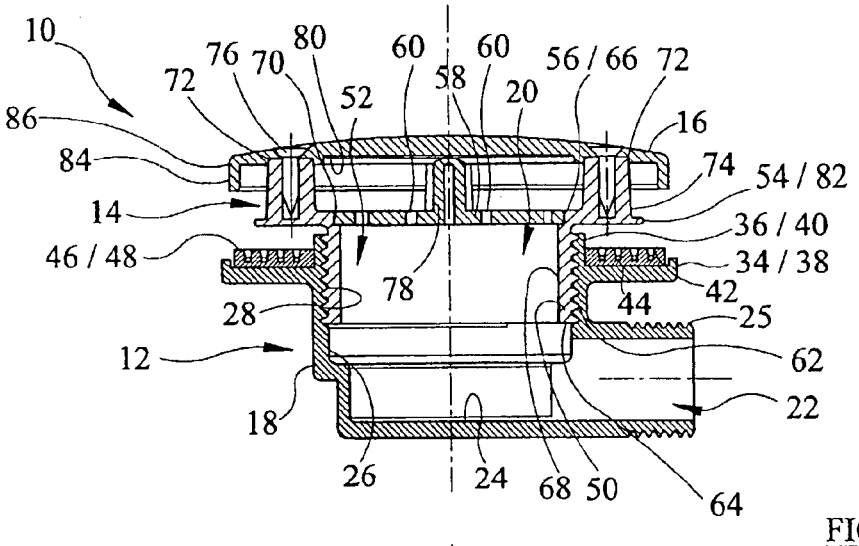
FIG. 2 is a cross-sectional side view of the waste water outlet unit shown in FIG. 1.
Figure 3:
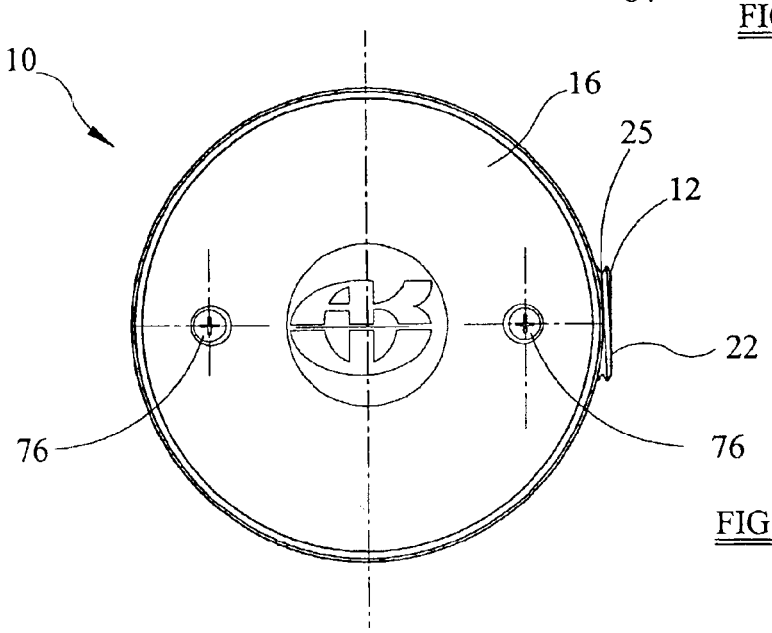
FIG. 3 is a top plan view of the waste water outlet unit shown in FIG. 1.

Referring firstly to FIGS. 1 to 3, a waste water outlet unit 10 is shown which comprises a base element 12, a clamp element 14 and a cover 16, all of which are typically made from moulded plastics material.

The base element 12 is in the form of a cylindrical or substantially cylindrical hollow base body 18 having a waste water inlet 20 at one end and a waste water outlet 22 in or adjacent to its interior bottom surface 24. The waste water outlet 22 is adapted to be connectable to a standard, typically 15 millimeter, diameter drain pipe (not shown), and as such includes a threaded outlet portion 25 which can accept a suitable pipe connector.

The interior surface 26 of the wall of the base body 18 is formed with a screw-thread 28 which extends from the waste water inlet 20. The exterior surface 30 of the base body 18 may be formed with flats 32 for receiving a spanner, or other suitable tool, to aid installation.

The base element 12 also includes an outwardly projecting base flange 34 which is formed on the base body 18 at a position which is spaced from the edge of the waste water inlet 20 so that a spigot 36, which upstands from the base flange 34, is created.

The base flange 34 includes a peripheral upturned edge 38 and this, in conjunction with the exterior surface 40 of the spigot 36, forms a recessed seating 42 in which a, typically rubber, gasket 44 is positioned. The gasket 44 is dimensioned to be received as a tight fit over the spigot 36 and the upper surface 46 includes a plurality of planar or substantially planar concentric ridges 48, the reason for which will become apparent hereinafter.

The clamp element 14 comprises a clamp body 50 having a clamp aperture 52 coaxially formed therethrough, an outwardly projecting clamp flange 54 formed on the upper edge 56 of the clamp body 50, and a removable filter element 58 which has a plurality of filter apertures 60 and which acts to catch hair and other debris while allowing draining water to pass therethrough.

An external screw-thread 62, which is adapted to mate with the internal screw-thread 28 of the base body 18, extends from the bottom edge 64 of the clamp body 50, and the inwardly facing edge 66 of the clamp flange 54 is recessed relative to the inner surface 68 of the clamp body 50 to form a shoulder portion 70 at the upper end of the aperture on which the filter element can be seated. As shown in FIG 2, the filter element 58 is shaped such that no portion of the filter element extends below the shoulder portion 70.

A plurality of upstanding cover support members 72, being in this case four, are formed on the upper surface 74 of the clamp flange 54. The cover support members 72 support the cover 16 which is releasably fastened to two diametrically opposed cover support members 72 by two respective screw-threaded fasteners 76.

An upstanding elongate peg element 78 is formed centrally or substantially centrally on the filter element 58. The peg element 78 prevents removal or displacement of the filter element 58 when the cover 16 is fully fastened to the cover support members 72, and as such abuts, or can abut, the bottom surface 80 of the cover 16.

The peg element 78 can also act as a handle by which the filter element 58 can be grasped, for example during removal or placement of the filter element 58.

The cover 16 extends over the clamp element 14 and beyond the peripheral edge 82 of the clamp flange 54. The peripheral edge 84 of the cover 16 is downturned to form a skirt portion 86.

In use, the waste water outlet 22 of the base body 18 is typically first connected to the drain pipe. The waste water outlet unit 10 is for use with a pumped-waste kind of shower tray (not shown), and therefore a pump (not shown) is connected to the aforementioned drain pipe to draw the waste water out of the base body 18. This dispenses with the need for a trap, and as such the waste water outlet unit 10 is a trapless unit. However, it would be possible to use the trapless unit 10 as part of a non-pumped shower tray assembly.

The base element 12 of the waste water outlet unit 10 is positioned beneath the shower tray and the spigot 36 is located in a drain opening of the shower tray so that the upper surface 46 of the gasket 44 contacts the underside surface of the shower tray and the drain opening is completely covered.

The clamp element 14 is located on the topside of the shower tray and the external screw-thread 62 of the clamp element 14 is engaged with the internal screw-thread 28 of the base body 18 and tightened until the base element 12 is firmly clamped to the underside of the shower tray through the base and clamp flanges 34 and 54.

Since shower trays are typically formed from glass reinforced plastic (GRP), the underside surface is often not particularly smooth or flat. As the clamp element 14 is tightened to the base element 12, the ridges 48 of the gasket 44 deform to follow the contours of the underside surface surrounding the drain opening and therefore provide a fluid-tight or substantially fluid-tight seal to prevent leakage between the edge of the drain opening and the unit 10.

The removable filter element 58, with the peg element 78 facing upwards, is then seated on the shoulder portion 70 of the clamp body 50, and the cover 16 is placed on the cover support members 72 and fastened in place by the screw-threaded fasteners 76.

When access to the interior of the waste water outlet unit 10 is required, for example, for cleaning or maintenance, the screw-threaded fasteners 76 holding the cover 16 in place are released, the cover 16 is lifted away or removed from the cover support members 72 independently of the filter element 58, and the filter element 58 is removed. Unhindered access is thus provided through the clamp aperture 52 of the clamp element 14 to the interior of the base body 18 while maintaining the clamping engagement of the base element 12 to the underside of the shower tray through the base and the clamp flanges 34 and 54.

Thereafter, the filter element 58 can be replaced and the cover 16 can be easily reattached.

Since the waste water outlet unit 10 is generally to be used with a pumped-waste shower tray, the skirt portion 86 of the cover 16 advantageously acts to restrict the flow rate, thereby decreasing the amount of air which is drawn through the unit 10 with the waste water and reducing the audible operational noise transmitted into the shower area.

Figure 4:
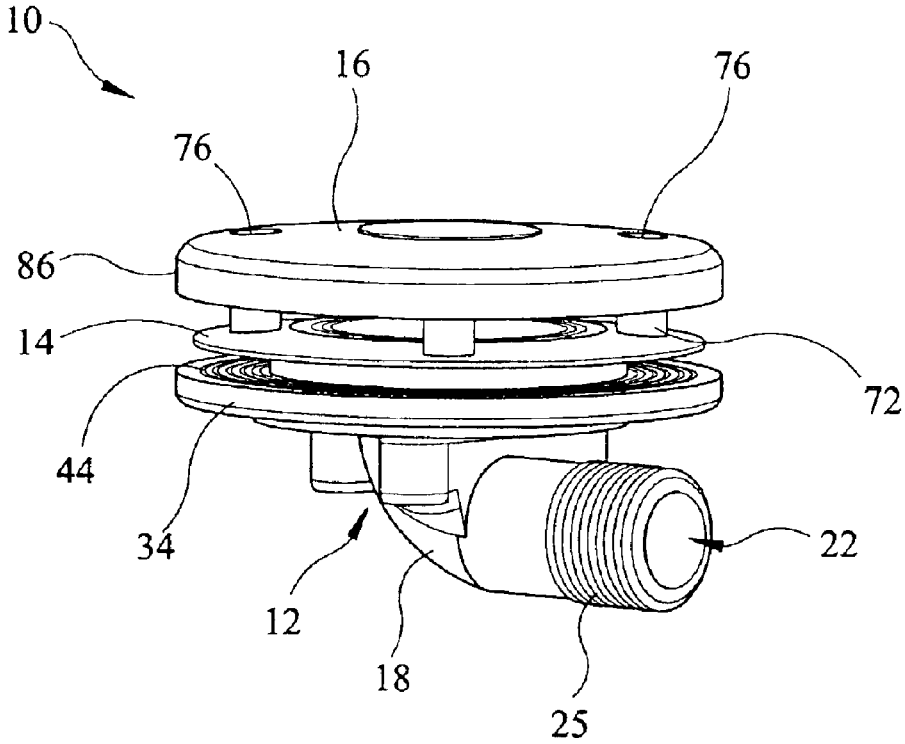
FIG. 4 is a perspective view of a second embodiment of a waste water outlet unit, in accordance with the present invention.
Figure 5:
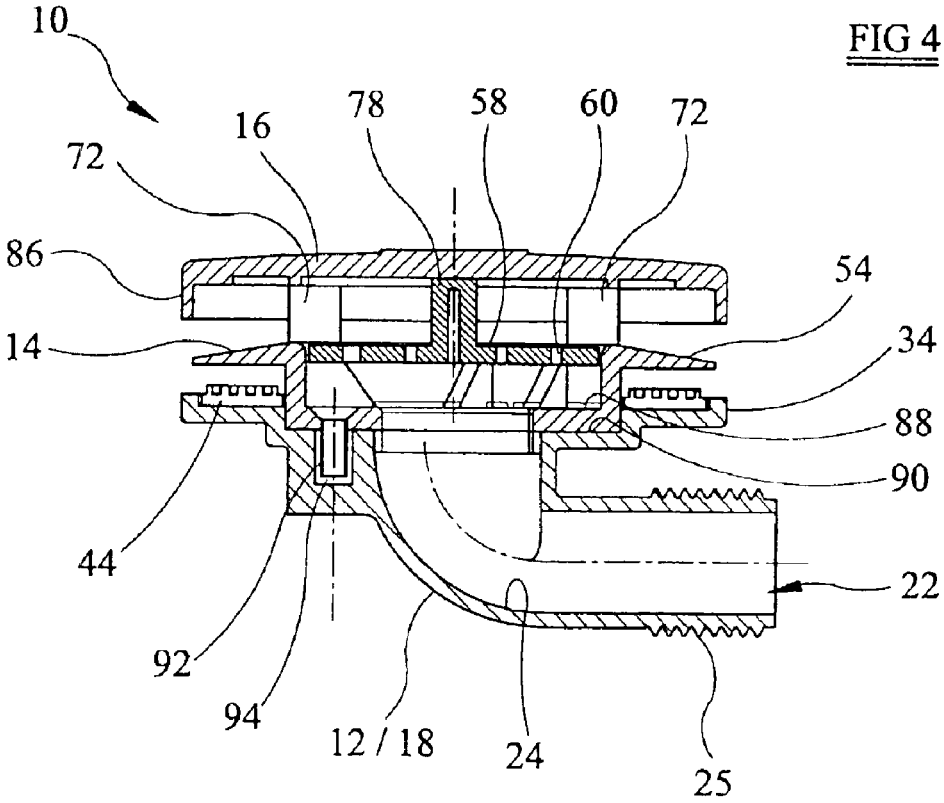
FIG. 5 is a cross-sectional side view of the waste water outlet unit shown in FIG. 4.

Referring now to FIGS. 4 and 5, a second embodiment of the waste water outlet unit 10 is shown. In this embodiment, only the parts that differ will be described, and those references which have been used in describing the first embodiment refer to like or similar parts.

In this embodiment, the clamp element 14 includes a second inwardly extending shoulder portion 88 which seats on a complementary shoulder portion 90 formed in the base body 18 adjacent to the base flange 34.

The clamp element 14 is releasably engaged with the base element 12 using a plurality of screw-threaded fastening elements 92 (only one shown in FIG. 5) which are equidistantly or substantially equidistantly spaced around, and which pass through, the second clamp shoulder portion 88 and engage with respective recesses 94 formed in the complementary base shoulder portion 90 of the base body 18. As such, the mating internal and external screw-threads 28 and 62 of the first embodiment can be dispensed with.

It is therefore possible to provide a waste water outlet unit which does not become spaced or detached from the shower tray when accessed or opened. It is also possible to provide improved sealing and thereby prevent leakage.

The embodiments described above are given by way of example only and various modifications will be apparent to persons skilled in the art without departing from the scope of the invention as defined by the appended claims. For example, the cover, instead of by screw-threaded fasteners, could be removably attachable to the clamp element by any other suitable means, such as by snap-fit engagement.

What is claimed is:

1. A waste water outlet unit for a shower tray having a drain opening, the unit comprising a base element which is locatable on the underside of the shower tray to cover the drain opening, and a clamp element which is locatable on the topside of the shower tray and which is engageable with base element to clamp the base element to the underside of the shower tray, the clamp element having an aperture through which waste water from the shower tray can pass into the base element, a filter element which is positionable over the aperture and which can be removed to enable access to the interior of the unit while maintaining the engagement between the base and clamp elements and a removable cover which, when in place, prevents removal of the removable filter element and which, in use, restricts the flow rate of liquid into the base element, and fasteners engaging said cover and said clamp element for releasably attaching said cover to said clamp element whereby the removable cover is removable independently of the filter element.

2. A unit as claimed in claim 1, wherein said fasteners are screw threaded fasteners.

3. A unit as claimed in claim 2, wherein the clamp element includes a plurality of upstanding cover support members, the cover being releasably fastened to two or more of the cover support members by respective said screw-threaded fasteners.

4. A unit as claimed in claim 1, wherein the removable filter element includes an upstanding peg element which, when the cover is in place, abuts or can abut the cover to prevent removal of the filter element.

5. A unit as claimed in claim 1, wherein the base element includes a hollow body having a waste water inlet, a waste water outlet at or adjacent to its interior bottom surface, an outwardly projecting flange formed adjacent to the waste water inlet, and spigot formed around the waste water inlet and dimensioned to be received in the drain opening of the shower tray.

6. A unit as claimed in claim 5, wherein the projecting flange supports a gasket for providing a fluid-tight or substantially fluid-tight seal between the base element and the shower tray when the base element is clamped to the shower tray.

7. A unit as claimed in claim 6, wherein the in use upper surface of the gasket includes a plurality of planar or substantially planar concentric ridges.

8. A unit as claimed in claim 5, wherein the waste water outlet of the base element is a pumped outlet.

9. A unit as claimed in claim 1, wherein the base element is internally threaded and the clamp element has a mating external thread to provide screw-threaded engagement between the clamp element and the base element.

10. A unit as claimed in claim 1, wherein the clamp element is engaged with the base element by a plurality of screw-threaded fastening elements.

11. A waste water outlet unit as claimed in claim 1 in combination with a shower tray having a drain opening.

12. A combination as claimed in claim 11, wherein the shower tray is a pumped waste shower tray.

13. A waste water outlet unit for a shower tray having a drain opening, the unit comprising:

a base element having a waste water inlet and a waste water outlet, said base element being locatable on the underside of the shower tray to cover the drain opening;

a clamp element which is locatable on the top side of the shower tray, and which is engageable with the base element to clamp the base element to the underside of the shower tray, said clamp element having an aperture through which waste water from the shower tray can pass into the base element, said aperture including a shoulder portion at an upper end thereof;

a filter element, which in use, is seated on said shoulder portion, wherein said filter element is shaped such that no portion of said filter element extends below said shoulder portion;

said filter element removable to enable access to the interior of the unit while maintaining the engagement between the base element and clamp element; and a removable cover, which when in place, prevents removal of the removable filter element, and which in use, restricts the flow rate of liquid into the base element.

14. The waste water outlet unit according to claim 13, wherein the removable cover is removable independently of the filter element.

* * * * *